US006607353B2

(12) United States Patent
Masutani

(10) Patent No.: US 6,607,353 B2
(45) Date of Patent: Aug. 19, 2003

(54) CENTRIFUGAL COMPRESSOR

(75) Inventor: Joo Masutani, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/912,544

(22) Filed: Jul. 26, 2001

(65) Prior Publication Data

US 2003/0021677 A1 Jan. 30, 2003

(51) Int. Cl.[7] ..... F01D 17/12
(52) U.S. Cl. ..... 415/161; 415/164; 415/208.4
(58) Field of Search ..... 415/161, 150, 415/148, 162, 163, 164, 208.3, 208.4, 208.2

(56) References Cited

U.S. PATENT DOCUMENTS

| | | | | |
|---|---|---|---|---|
| 3,424,372 A | * | 1/1969 | Blattner et al. | |
| 3,861,826 A | * | 1/1975 | Dean, Jr. | 415/211 |
| 4,338,063 A | | 7/1982 | Nakanishi | |
| 4,770,605 A | | 9/1988 | Nakatomi | |
| 4,780,049 A | * | 10/1988 | Palmer et al. | 415/36 |
| 4,877,370 A | * | 10/1989 | Nakagawa et al. | 415/148 |
| 5,152,661 A | * | 10/1992 | Sheets | 415/84 |
| 5,178,516 A | * | 1/1993 | Nakagawa et al. | 415/208.3 |
| 5,460,484 A | | 10/1995 | Yagi | |
| 5,516,263 A | * | 5/1996 | Nishida et al. | 415/208.2 |
| 5,518,365 A | | 5/1996 | Baets et al. | |
| 5,618,160 A | * | 4/1997 | Harada et al. | 415/17 |
| 5,683,223 A | * | 11/1997 | Harada et al. | 415/17 |
| 5,730,580 A | | 3/1998 | Japikse | |
| 5,873,696 A | * | 2/1999 | Harada et al. | 415/148 |
| 5,947,680 A | * | 9/1999 | Harada et al. | 415/17 |
| 6,050,775 A | | 4/2000 | Erdmann et al. | |

FOREIGN PATENT DOCUMENTS

| | | |
|---|---|---|
| EP | 0 603 828 | 6/1994 |
| EP | 0 622 549 | 11/1994 |
| EP | 0 908 631 | 4/1999 |

OTHER PUBLICATIONS

Figure 10.28 of "Turbomachinry Diffuser Technology", published by Concepts ETI, Inc. 1984.
Figures 3.9 and 3.10 of "Fluid Machinery" (w/ English Abstract), published in Taiwan on May 20, 1999.

* cited by examiner

*Primary Examiner*—Edward K. Look
*Assistant Examiner*—J. M McAleenan
(74) *Attorney, Agent, or Firm*—Oblon, Spivak, McClelland, Maier & Neustadt, P.C.

(57) ABSTRACT

The centrifugal compressor of the present invention is equipped with a plurality of vane groups (A, B) comprised of a plurality of vanes (16A, 16B) disposed in the peripheral direction of an impeller (12) so as to be concentric about the center of an axis of rotation (15) of the impeller, and the individual vanes (16A) belonging to vane group (A) nearest to the impeller are able to rotate. Since diffuser efficiency decreases if the intake flow volume of the impeller changes and the flow of gas is unable to easily continue from the vanes (16A) to vanes (16B), the vanes (16A) are rotated to change the inclination of the direction of a wing center line on their front edges so as to coincide with the direction of the flow of gas discharged from the impeller. As a result, diffuser efficiency is maintained at a high level even if the intake flow volume of the impeller is changed.

18 Claims, 7 Drawing Sheets

CENTRIFUGAL COMPRESSOR

BACKGROUND OF THE INVENTION

1. Field of the Invention

The present invention relates to a centrifugal compressor used in, for example, a small gas turbine or turbo refrigerating machine, and especially relates to a centrifugal compressor equipped with a typical vane type diffuser or a diffuser what is called a channel type diffuser.

2. Description of the Related Art

Centrifugal compressors are provided with a diffuser that functions as an apparatus that reduces the velocity of a gas and converts its kinetic energy into internal energy. An example of a centrifugal compressor provided with a diffuser is shown in FIGS. 9 and 10. The centrifugal compressor shown in the drawings is equipped with a casing 1, an impeller 2 that rotates by being axially supported by the casing 1, a scroll 3 provided integrated into a single unit with the casing 1 around the impeller 2, and a diffuser 4 provided in the shape of a ring so as to surround the impeller 2 between the impeller 2 and scroll 3.

The diffuser 4 is composed of a plurality of vanes 5 disposed separated from each other in the peripheral direction, and fulfills the function of moving the direction of flow of gas discharged from the impeller 2 closer to the outside in the radial direction, while also reducing the velocity to convert the dynamic pressure of the gas into static pressure.

However, in a centrifugal compressor as described above, since the inflow angle of air to the diffuser 4 changes when the intake flow volume of the impeller 2 is changed, even if for example, the direction of flow of gas discharged from the impeller 2 coincides with the direction of a wing center line on the front edge of the vane 5 at a certain intake flow volume, if the intake flow volume changes, both no longer coincide resulting in a decrease in diffuser efficiency. This causes the operating range from surge to choke to become narrower.

Therefore, although attempts have been made to reduce the ratio of chord length to the pitch between the vanes (chord-pitch ratio) and prevent the formation of a throat portion between the adjacent vanes in order to widen the operating range, this makes it difficult for conversion to static pressure to proceed and resulting in the problem of being unable to obtain adequate diffuser efficiency. Here, the throat portion refers to a space between the adjacent vanes extending from a line dropped down vertically from the front edge of the one vane to the wing center line to a line dropped down vertically from the rear edge of the other vane to the vane center line.

SUMMARY OF THE INVENTION

In consideration of the circumstances as described above, the object of the present invention is to provide a centrifugal compressor that allows a wider operating range from surge to choke by inhibiting decreases in diffuser efficiency even if the intake flow volume of the impeller is changed.

As a means for solving the above problems, a centrifugal compressor is employed having the structure described below. Namely, the first aspect of the present invention is a centrifugal compressor having a diffuser around an impeller; wherein, the diffuser is equipped with a plurality of vane groups comprised of a plurality of vanes disposed in the peripheral direction of the impeller so as to be concentric about the center of an axis of rotation of the impeller, and the more the vane belongs to the vane group positioned to the outside, the smaller the angle relative to the radial direction of the impeller.

In this centrifugal compressor, since conversion from dynamic pressure to static pressure for gas exhausted from the impeller proceeds with each passage of the gas through each vane group disposed in concentric circles, high efficiency is obtained when the gas passes through the outermost positioned vane group.

The second aspect of the present invention, is the centrifugal compressor according to the first aspect wherein, in any vane group excluding the vane group at a position nearest the impeller, the number of vanes belonging to the vane group is an integral multiple of the number of vanes belonging to the other vane group adjacent on the inside to the vane group.

The flow of gas discharged from the impeller is organized along vanes belonging to the vane group positioned nearest to the impeller during the course of passing through the vane group, and flow is formed such that it is curved in the direction of a wing center line behind (outside) the vanes. Conversion from dynamic pressure to static pressure proceeds with good efficiency if this flow is fed outward without weakening in each of the vane groups of the latter stage. In this centrifugal compressor, vanes that continue to send the flow of gas outward are always provided in each vane group, except for the vane group positioned nearest to the impeller, corresponding to individual vanes belonging the vane group positioned nearest to the impeller. As a result, conversion from dynamic pressure to static pressure proceeds with good efficiency thereby allowing the obtaining of high diffuser efficiency.

The third aspect of the present invention, is the centrifugal compressor according to the first or second aspect wherein, at least the vanes belonging to the vane group at the position nearest to the impeller are able to rotate individually by being axially supported by shafts parallel to the axis of rotation.

If the intake flow volume of the impeller changes, the direction of flow of gas discharged from the impeller, and the direction of the wing center line on the front edge of the vanes belonging to the vane group positioned nearest to the impeller no longer coincide, thereby making it difficult for the flow to continue and ending up decreasing diffuser efficiency. Therefore, the vanes are rotated so as to change the inclination of the direction of the wing center line on the front edge and coincide with the direction of flow of gas discharged from the impeller. As a result, diffuser efficiency is maintained at a high level if the intake flow volume of the impeller changes.

The fourth aspect of the present invention, is the centrifugal compressor according to the third aspect wherein, the rotatable vanes stand on flanges independent from the walls that form a portion of the diffuser separated in the direction of the axis of rotation with the vanes interposed between, and rotate with the flanges.

If composed so that only the vanes rotate, a gap ends up forming between the walls that form a portion of the diffuser and the vanes, which causes a disturbance in the flow of gas and a decrease in diffuser efficiency. Therefore, if the vanes stand on flanges and are rotated together with those flanges, there is no longer any gap between the walls and vanes, thereby enabling diffuser efficiency to be maintained at a high level without decreasing.

The fifth aspect of the present invention, is the centrifugal compressor according to the third or fourth aspect wherein, the vane group adjacent on the outside to the rotatable vanes is able to turn in the peripheral direction while maintaining the arrangement of the individual vanes.

Since turning the vanes causes the position of not only the front edge but also the rear edge to change, correlation with the leading edges of the vanes belonging to the vane group adjacent on the outside is no longer possible in terms of continuing the flow of gas to the outside, thereby causing a decrease in diffuser efficiency. Therefore, if the vane group adjacent on the outside to the rotatable vanes is allowed to turn in the peripheral direction while maintaining the arrangement of individual vanes, it becomes possible to correlate the rear edges of the rotatable vanes with the front edges of the vanes belonging to the vane group adjacent on the outside under any circumstances, thereby enabling diffuser efficiency to be maintained at a high level without decreasing.

The sixth aspect of the present invention, is the centrifugal compressor according to the third, fourth or fifth aspect wherein, the ratio of the chord length to the interval between the adjacent vanes in the peripheral direction of the rotatable vanes is less than 1.0.

Although the angle of the rotatable vanes relative to the radial direction of the impeller is set to become larger the smaller the intake flow volume of the impeller, and smaller the larger the intake flow volume of the impeller, if the vane angle approaches 90° by reducing the intake flow volume of the impeller (although the compressor is actually thought to become inoperable due to the occurrence of surging), interference can occur between the vanes. Therefore, if the ratio of chord length to the interval between the adjacent vanes in the peripheral direction is made to be less than 1.0, even if the vane angle becomes 90°, there is no occurrence of interference between the vanes, and operability is improved.

The seventh aspect of the present invention, is the centrifugal compressor according to one of the third to sixth aspects wherein, the ratio of the chord length to the interval between the adjacent vanes in the peripheral direction of those vanes belonging to the vane group adjacent on the outside to the rotatable vanes is from 0.5 to 2.0.

If the interval between the adjacent vanes in the peripheral direction is too open, this is not appropriate since it can cause disturbances in the flow of gas. Therefore, if the ratio of chord length to the interval between the adjacent vanes in the peripheral direction of those vanes belonging to the vane group adjacent on the outside to the rotatable vanes is made to be from 0.5 to 2.0, the gas flow is rectified thereby preventing decreases in diffuser efficiency.

The eighth aspect of the present invention, is the centrifugal compressor according to one of the first to seventh aspects wherein, the ratio of the length from the center of the impeller to the front edge of a vane belonging to the vane group at a position nearest the impeller toward the outer radius of the impeller is from 1.05 to 1.30.

Since the gas immediately after being discharged from the impeller has an uneven speed from the impeller until it enters the diffuser, the effects of the vanes are minimal, while the free vortex gaps where there are no vanes have more of an effect on improving diffuser efficiency. Therefore, if the ratio of the length from the center of the impeller to the front edge of a vane belonging to the vane group positioned nearest the impeller to the outer radius of the impeller is made to be from 1.05 to 1.30, since free vortex gaps where there are no vanes are provided to the inside of the diffuser, thereby improving diffuser efficiency.

DETAILED DESCRIPTION OF THE PREFERRED EMBODIMENTS

Figure 1:
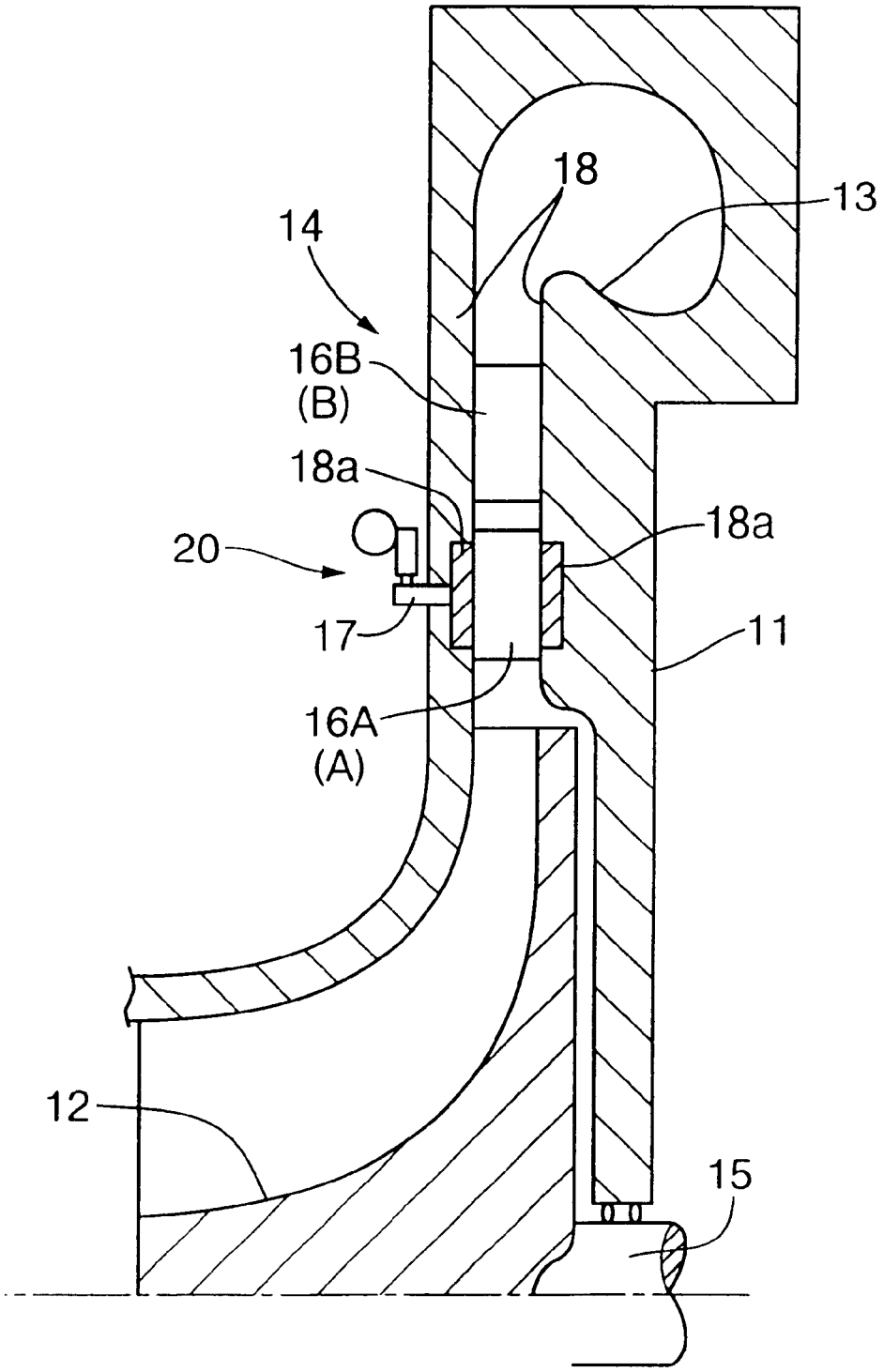
FIG. 1 is a cross-sectional view as viewed from the side of a centrifugal compressor showing a first embodiment of the centrifugal compressor of the present invention.
Figure 2:
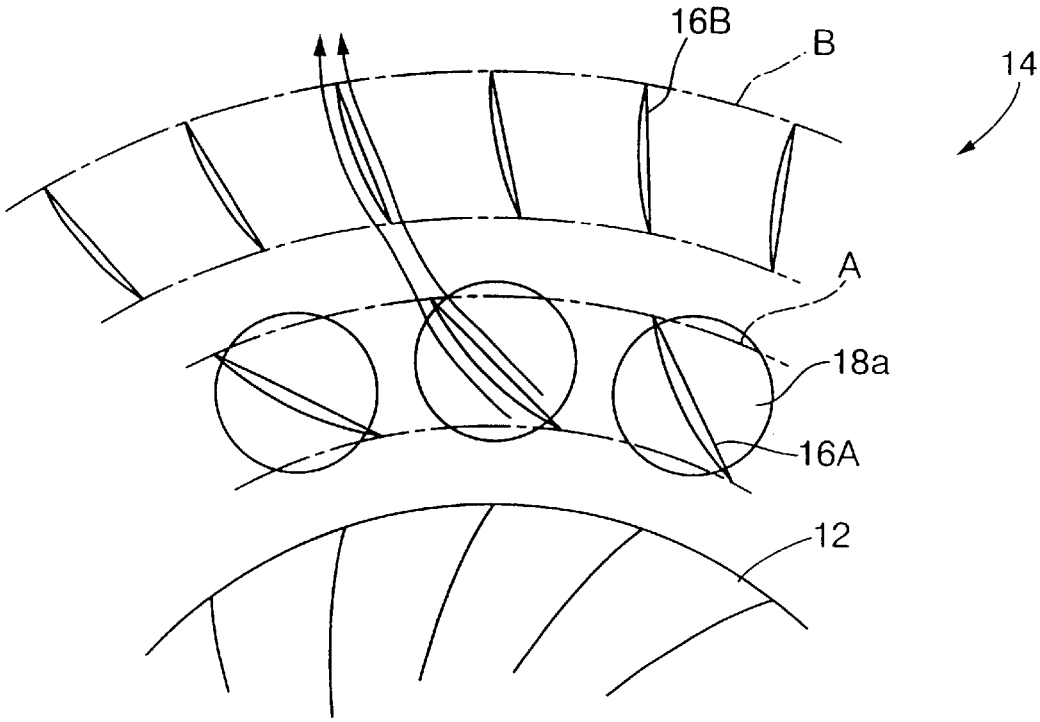
FIG. 2 is a cross-sectional view as viewed from the axial direction of a centrifugal compressor.
Figure 3:
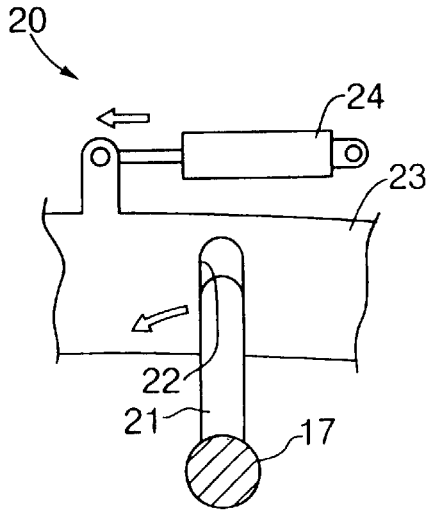
FIG. 3 is a cross-sectional views of the essential portion showing the structure of a rotating mechanism.

The following provides a detailed explanation of a first embodiment of the centrifugal compressor of the present invention with reference to FIGS. 1 through 3.

The centrifugal compressor shown in FIG. 1 is equipped with a casing 11, an impeller 12 that rotates by being axially supported by the casing 11, a scroll 13 provided integrated into a single unit with the casing 11 around the impeller 12, and a diffuser 14 provided in a ring shape so as to surround the impeller 12 between the impeller 12 and scroll 13.

As shown in FIG. 2, the diffuser 14 is equipped with two vane groups A and B comprising a plurality of vanes disposed separated at equal intervals along the peripheral direction of the impeller 12 such that the vane group A is disposed on the inside while the vane group B is disposed on the outside to form concentric circles an axis of rotation 15 of the impeller 12 in the center.

Vanes 16A belonging to the vane group A and vanes 16B belonging to the vane group B all have a wing-shaped cross-section, and the number of the vanes 16B belonging to the vane group B is two times the number of the vanes 16A belonging to the vane group A.

Although the vanes 16A and 16B are each disposed at prescribed angles relative to the radial direction of the impeller 12, the angle relative to the radial direction of the impeller 12 of the vanes 16B positioned on the outside is smaller than that of the vanes 16A positioned on the inside.

In addition, each vane 16A belonging to the vane group 16 being disposed between walls 18 of the casing 11 that form a portion of the diffuser 14 separated in the direction of the axis of rotation 15 with these vanes 16A interposed between, and each vanes 16A is fixed between flanges 18*a* independent from the walls 18 and is axially supported by a shaft 17 built in the casing 11 and parallel to the axis of rotation 15. The surfaces of the flanges 18*a* are nearly in the same plane with the walls 18. Each vane 16A is rotated synchronously by a rotating mechanism 20, enabling the angle relative to the radial direction of the impeller 12 to be changed. However, the angles of the vanes 16A may not, even at the minimum, be smaller than the angles of the vanes 16B.

As shown in FIG. 3, the rotating mechanism 20 is equipped with a fixed arm 21 on the outside of the casing 11 so as to cross the shaft 17 of each vane 16A in the lengthwise direction, a coupling ring 23 disposed concentrically relative to the vane group A that is able to rotate in the peripheral direction and has a slide groove 22 that engages each arm 21 while allowing each arm 21 to slide freely inside, and a drive cylinder 24 that turns the coupling ring 23 in the peripheral direction within a prescribed range. This rotating mechanism 20 turns the coupling ring 23 by expanding the drive cylinder 24, and causes the coupling ring 23 to swing all arms 21 accompanying this turning, thereby causing each shaft 17 and vane 16A axially supported by it to rotate in synchronization. Furthermore, the rotating range (angle) of each vane 16A is defined by the width of expansion of the drive cylinder 24, and is about ±15° based on design point.

In the above-mentioned centrifugal compressor, each vane 16A is disposed so that the ratio of the chord length to the interval with the adjacent vane 16A in the peripheral direction is less than 1.0. In addition, each vane 16A is disposed so that the ratio of the length from the from the center of the impeller 12 to the front edge of the vane 16A to the outer radius of the impeller 12 is from 1.05 to 1.30. Moreover, each vane 16B is disposed so that the ratio of the chord length to the interval with the adjacent vane 16B in the peripheral direction is from 0.5 to 2.0.

In the centrifugal compressor composed in the manner described above, since conversion from dynamic pressure to static pressure is able to proceed each time gas discharged from the impeller 12 passes through each vane group, high diffuser efficiency is obtained when it passes through the vane group B.

The flow of gas discharged from the impeller 12 is organized along the vanes 16A during the course of passing through the vanes 16A, and as shown in FIG. 2, and a flow is formed such that the flow is curved in the direction of the wind center line behind the vanes 16A. The conversion from dynamic pressure to static pressure proceeds efficiently if this flow is sent to the outside without weakening in the vanes 16B. Therefore, in the above-mentioned centrifugal compressor, as a result of making the number of vanes 16B twice (integral multiple) of the number of vanes 16A, there is always the vane 16B provided in the vane group B that continues to send the flow of gas to the outside corresponding to each vane 16A belonging to the vane group A, and as a result, the conversion from dynamic pressure to static pressure proceeds efficiently.

However, if the intake flow volume of the impeller 12 is changed, the direction of the flow of gas discharged from the impeller 12 and the direction of the wing center line on the front edge of the vanes 16A belonging to the vane group A no longer coincide, thereby making it difficult for the flow to continue and lowering diffuser efficiency. Therefore, in the above-mentioned centrifugal compressor, the vanes 16A are rotated by a certain angle to change the inclination of the direction of the wing center line on the front edge and allow it to coincide with the direction of flow of the gas discharged from the impeller 12, thereby maintaining high diffuser efficiency even if the intake flow volume of the impeller 12 is changed.

If composed such that only the vanes 16A rotate, gaps are formed between the walls 18 of the casing 11 that constitute a portion of the diffuser 14 and the vanes 16A, which in turn disturb the flow of gas and cause a decrease in diffuser efficiency. Therefore, in the above centrifugal compressor, the vanes 16A are fixed between the flanges 18*a*, and made to rotate as a single unit with flanges 18*a*. Consequently, the gaps between the walls 18 and vanes 16A are eliminated, thereby preventing decreases in diffuser efficiency.

Although the angle of the vanes 16A relative to the radial direction of the impeller 12 is set to be larger the smaller the intake air volume of the impeller 12 and smaller the larger the intake air volume of the impeller 12, if the intake air volume of the impeller 12 is reduced and the angle of the vanes 16A approaches 90° (although the compressor is actually thought to become inoperable due to the occurrence of surge), interference can occur between the vanes 16A. Therefore, in the above centrifugal compressor, the ratio of the chord length to the interval between the adjacent vanes 16A is set to be less than 1.0, and as a result, there is no occurrence of interference between the vanes 16A even if the angle of the vanes 16A reaches, for example, 90°.

If the interval between the adjacent vanes 16B is too open, it is not suitable because this causes a disturbance in the gas flow. Therefore, in the above centrifugal compressor, the ratio of chord length to the interval between the adjacent vanes 16B is set to a value from 0.5 to 2.0, and as a result, the gas is rectified which in turn prevents decreases in diffuser efficiency.

Since the speed of the gas from the impeller 12 until enter into the diffuser 14 is uneven immediately after being discharged from the impeller 12, the effects of the vanes are minimal, while free vortex gaps where there are no vanes have more of an effect on improving diffuser efficiency. Therefore, in the above centrifugal compressor, the ratio of the length from the center of the impeller 12 to the front edges of the vanes 16A belonging to the vane group A is set to a value from 1.05 to 1.30, and as a result, since the free vortex gaps where there are no vanes are provided to the inside of the diffuser 14, diffuser efficiency is improved.

As has been described above, according to the above centrifugal compressor, diffuser efficiency can be maintained at a high level while ensuring a wide operating range.

In the present embodiment, however, although the number of the vanes 16B is double the number of the vanes 16A, and every other vane 16B is provided corresponding to the vanes 16A, if improvement of diffuser efficiency is expected, then the number of the vanes 16B may be three times or four times the number of the vanes 16A.

Next, an explanation is provided of a second embodiment of the centrifugal compressor of the present invention with reference to FIGS. 4 through 7. In this explanation, those members previously explained in the above-mentioned first embodiment are indicated with the same reference symbols, and their explanation is omitted.

Figure 4:
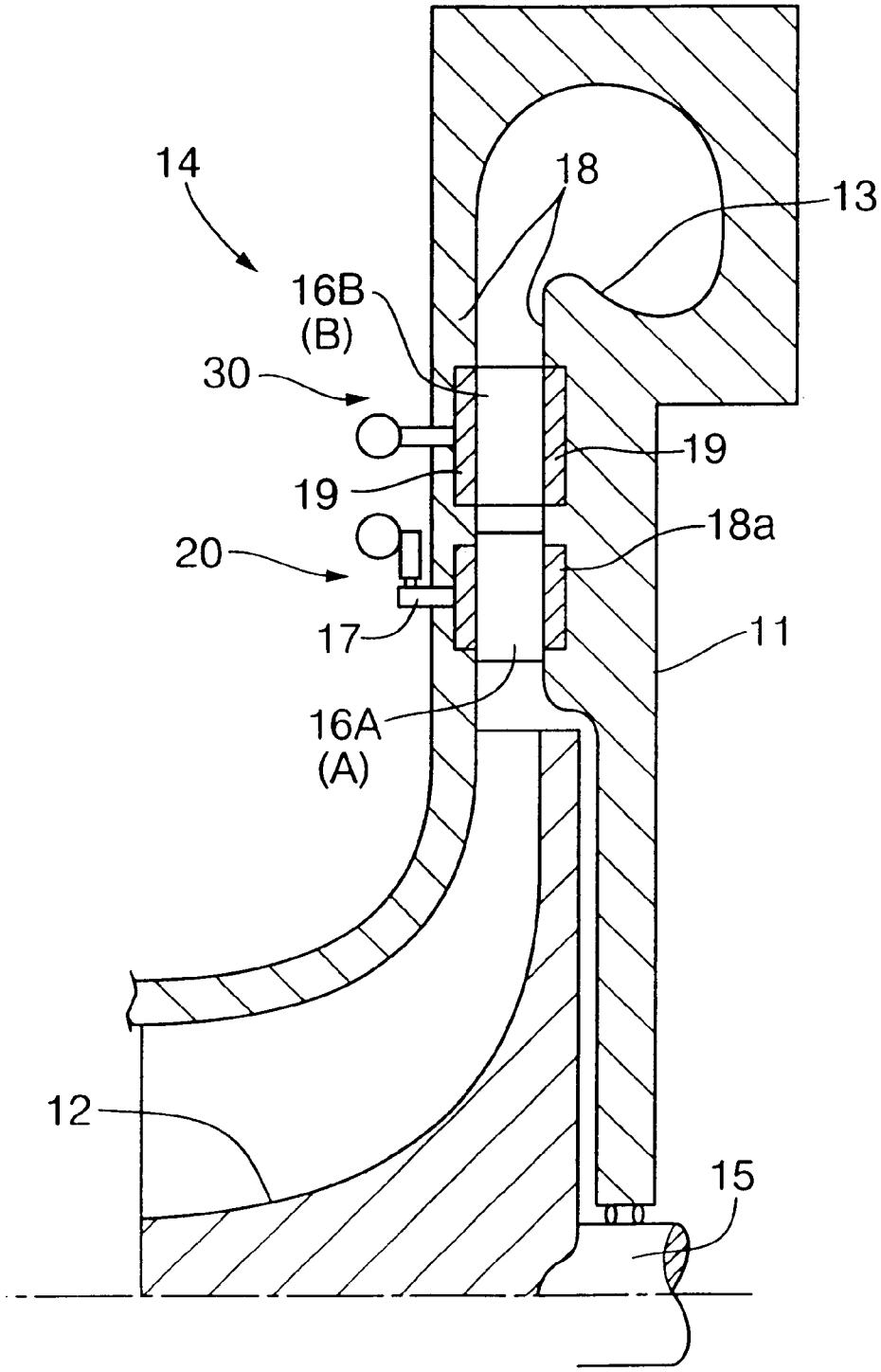
FIG. 4 is a cross-sectional view as viewed from the side of a centrifugal compressor showing a second embodiment of the centrifugal compressor of the present invention.

In the present embodiment, as shown in FIG. 4, the vanes 16B are fixed so as to be interposed between ring plates 19 disposed concentrically with the vane group B along walls 18 of casing 11 that constitutes a portion of the diffuser 14. The vane group B is able to turn in the peripheral direction while maintaining the arrangement of the individual vanes 16B by a turning mechanism 30 which turns the ring plates 19 in the peripheral direction.

Figure 5:
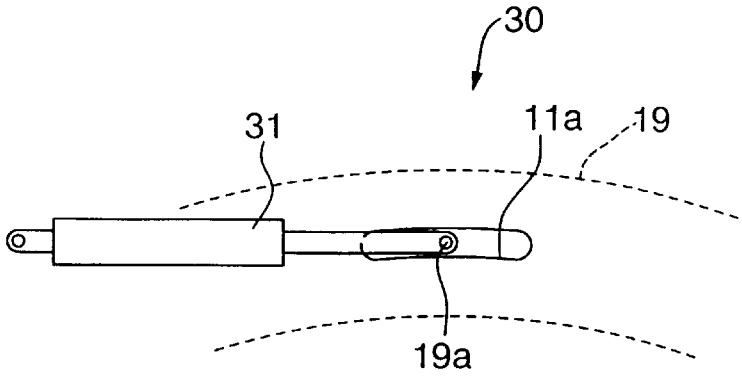
FIG. 5 is a cross-sectional view of the essential portion showing the structure of a turning mechanism.
Figure 6:
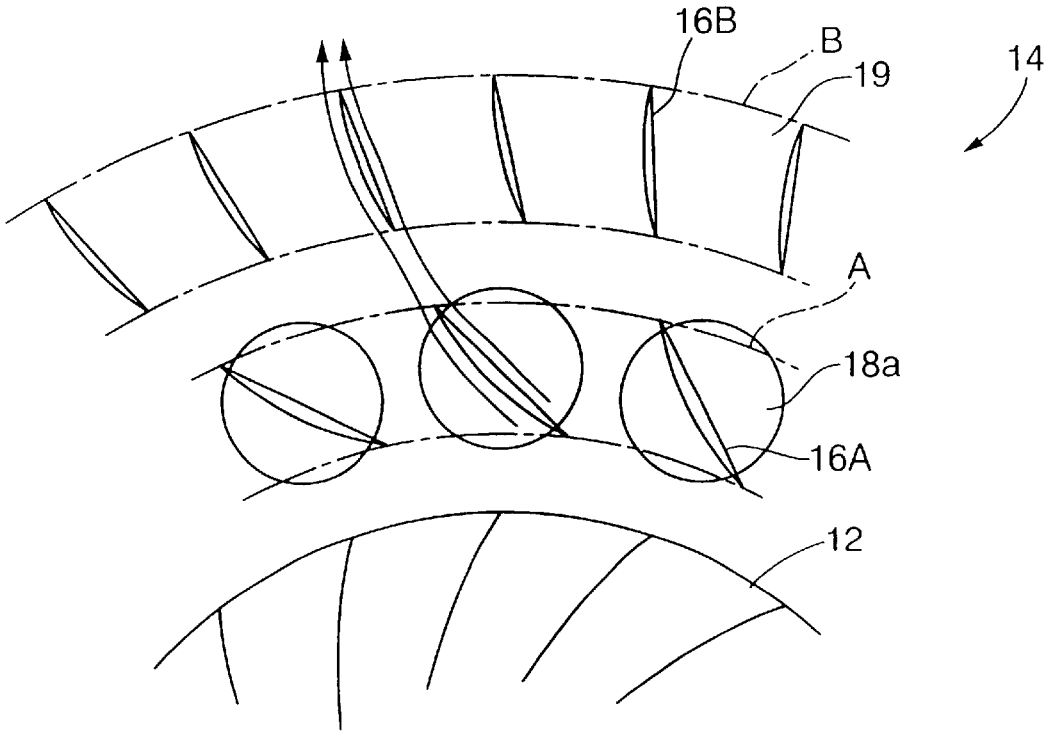
FIG. 6 is a cross-sectional view for explaining the arrangement of vanes belonging to each vane group and the flow of gas.

As shown in FIG. 5, each ring plate 19 is equipped with a drive cylinder 31 having a dive shaft coupled to a pin 19*a* that protrudes outside of the casing 11 from the ring plate 19 through an arc-shaped slot 11*a* opened in the casing 11 according to the peripheral direction of the ring plate 19. The ring plate 19 turns by expanding drive cylinder 31, and is made to turn in the peripheral direction while maintaining the arrangement of individual vanes 16B. Furthermore, the rotating range (angle) of the vanes 16B is defined by the width of expansion of the drive cylinder 31, and is about ±10° based on design point.

In the centrifugal compressor composed in the manner described above, as shown in FIG. 6, if the intake flow volume of the impeller 12 is changed from a stable operating state in which the flow of gas is continued from the vanes 16A to the vanes 16B with little loss, the angle of the vanes 16A must be changed. However, if the vanes 16A are rotated, since not only the positions of the front edges but also the rear edges also change, correlation with the front edges can no longer be maintained in terms of the flow of gas continuing to the rear, thereby causing a decrease in diffuser efficiency.

Figure 7:
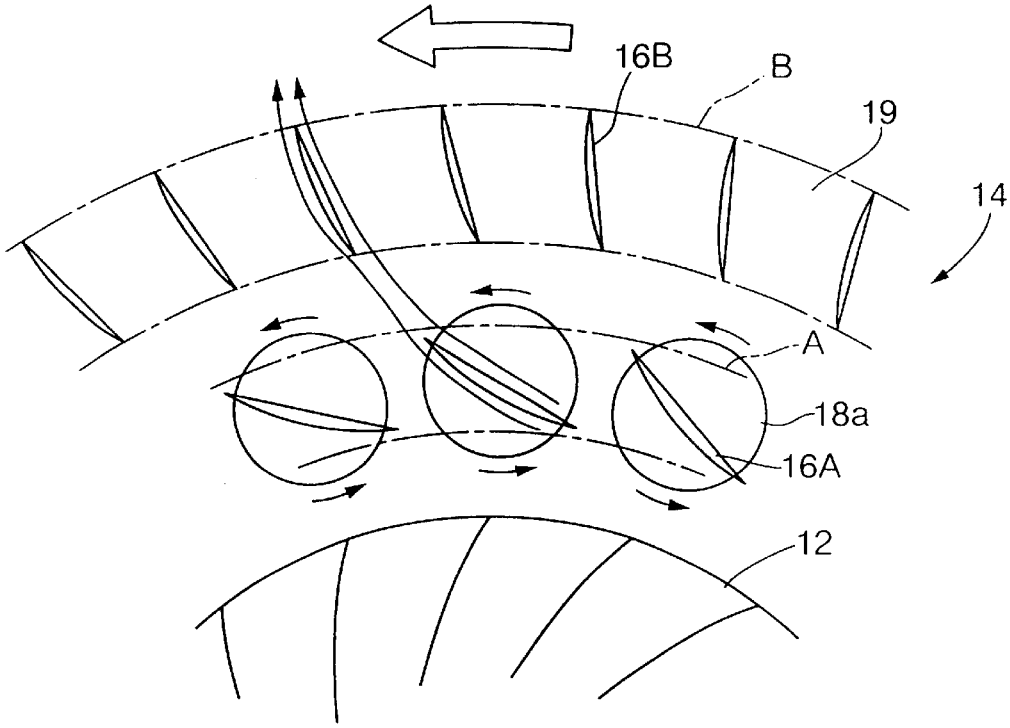
FIG. 7 is a similar cross-sectional view for explaining the arrangement of vanes belonging to each vane group and the flow of gas.

Therefore, in the above centrifugal compressor, by turning the vane group B in the peripheral direction while maintaining the arrangement of the individual vanes 16B as shown in FIG. 7, the front edges of the vanes 16B and the rear edges of the vanes 16B can be correlated under any circumstances, thereby preventing decreases in diffuser efficiency even if the intake flow volume of the impeller 12 is changed.

As has been described above, according to the above centrifugal compressor, although there are disadvantages including the structure becoming complex as a result of providing the turning mechanism 30 and energy being required to operate the turning mechanism 30, since the flow of gas can be continued from the vanes 16A to vanes 16B with little loss, diffuser efficiency can be maintained at a high level in all operating states from surge to choke.

Figure 8:
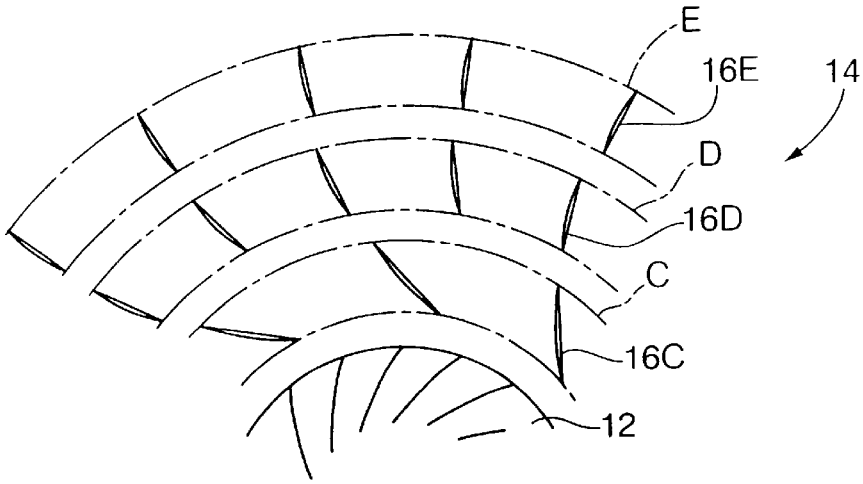
FIG. 8 is a cross-sectional view as viewed from the side of a centrifugal compressor showing a third embodiment of the centrifugal compressor of the present invention.
Figure 9:
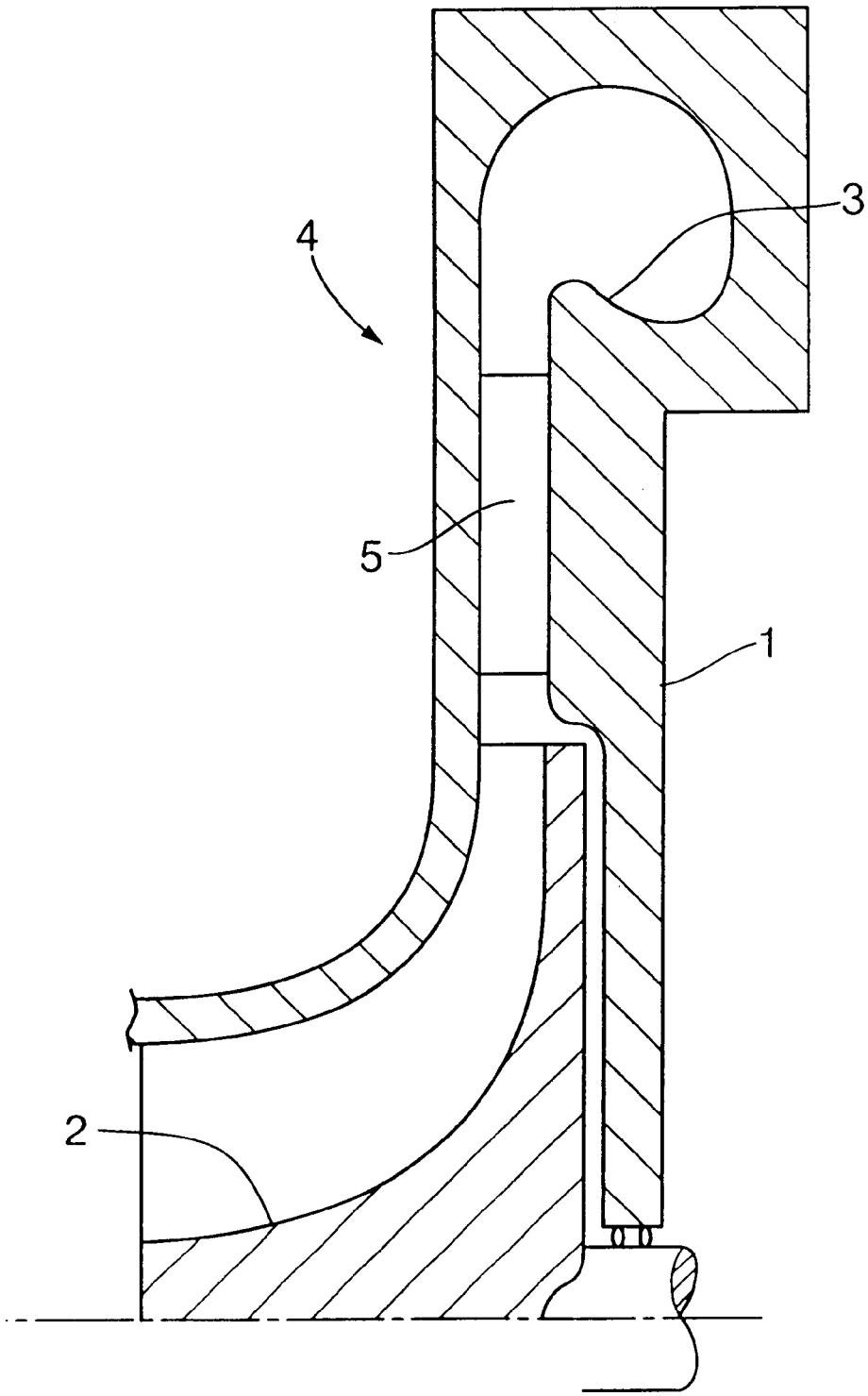
FIG. 9 is a cross-sectional view as viewed from the side of a centrifugal compressor showing the structure of a centrifugal compressor of the prior art.
Figure 10:
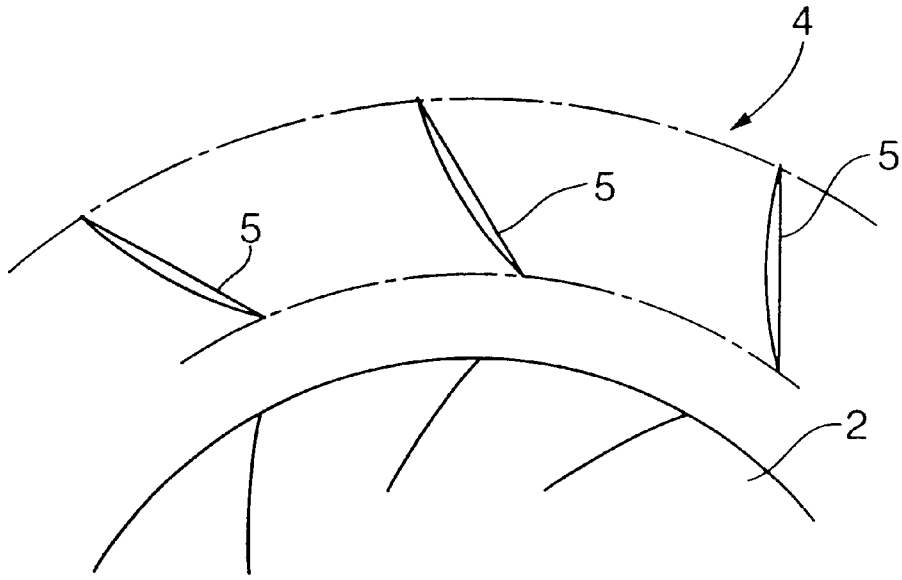
FIG. 10 is a cross-sectional view as viewed from the axial direction of a centrifugal compressor of the prior art.

Next, an explanation is provided of a third embodiment of the centrifugal compressor of the present invention with reference to FIG. 8. Similar to the two embodiments previously mentioned, those members that have been previously explained are indicated with the same reference symbols, and their explanations are omitted.

In the present embodiment, the diffuser 14 is composed by concentrically disposing three vane groups C, D and E. All vanes 16C, 16D and 16E belonging to each vane group C, D and E are disposed such that the chord-pitch ratio of each bane is considerably smaller as compared with the previously described embodiments, and the more the vane belongs to the vane group positioned to the outside, the smaller the angle relative to the radial direction of the impeller. In addition, all of the vanes are fixed between the walls 18 (not shown in FIG. 8).

The vanes 16C are given a suitable angle so as that the orientation of the front edges coincide with the direction of the flow of gas discharged from the impeller 12 for a certain intake flow volume, the vanes 16D are given a suitable position and suitable angle relative to the vanes 16C so that the flow of gas generated behind the vanes 16C is able to continue with little loss, and the vanes 16E are given a suitable position and suitable angle relative to the vanes 16D so that the flow of gas generated behind the vanes 16D is able to continue with little loss.

In addition, every other vane 16D belonging to the vane group D and the vane 16E belonging to the vane group E are provided that do not correlate with the vanes 16C, and the numbers of the vanes 16D and 16E are both double the number of the vanes 16C.

In the above centrifugal compressor, in contrast to the chord-pitch ratio being set to be small enabling a wide operating range from surge to choke, high diffuser efficiency is unable to be obtained. However, in the above centrifugal compressor, since the conversion from dynamic pressure to static pressure proceeds whenever gas discharged from the impeller 12 passes through each vane group C, D and E, high diffuser efficiency is obtained while maintaining a wide operating range when the gas passes through the vane group E.

In addition, in the above centrifugal compressor, the vanes 16D and 16E are provided in the vane groups D and E that continue to send the flow of gas outward corresponding to the individual vanes 16C belonging to the vane group C, thereby promoting efficient conversion of dynamic pressure to static pressure.

However, although each of the above embodiments has provided an explanation of a diffuser equipped with 2 or 3 vane groups, the diffuser may also be composed so as to be provided with four or more vane groups so as to carry out the conversion from dynamic pressure to static pressure over more stages. In this case, it goes without saying that the vane groups should be disposed so that the more a vane belongs to a vane group positioned to the outside, the smaller the angle relative to the radial direction of said impeller.

What is claimed is:

1. A centrifugal compressor having a diffuser around an impeller, wherein said diffuser is equipped with a plurality of vane groups comprised of a plurality of vanes disposed in a peripheral direction of said impeller so as to be concentric about an axis of rotation of said impeller, and wherein the further a first vane group of the plurality of vane groups is positioned from the axis of rotation as compared to another vane group of the plurality of vane groups, the smaller an angle relative to a radial direction of said impeller of a vane of the first vane group as compared to an angle relative to the radial direction of a vane of the another vane group.

2. The centrifugal compressor according to claim 1 wherein, in any vane group excluding the vane group at a position nearest said impeller, the number of vanes belonging to said vane group is an integral multiple of the number of vanes belonging to the other vane group adjacent on the inside to said vane group.

3. The centrifugal compressor according to claim 1 wherein, at least the vanes belonging to the vane group at the position nearest to said impeller are able to rotate individually by being axially supported by shafts parallel to said axis of rotation.

4. The centrifugal compressor according to claim 2 wherein, at least the vanes belonging to the vane group at the position nearest to said impeller are able to rotate individually by being axially supported by shafts parallel to said axis of rotation.

5. The centrifugal compressor according to claim 3 wherein, said rotatable vanes stand on flanges independent from the walls that form a portion of said diffuser separated in the direction of said axis of rotation with said vanes interposed between, and rotate with said flanges.

6. The centrifugal compressor according to claim 4 wherein, said rotatable vanes stand on flanges independent from the walls that form a portion of said diffuser separated in the direction of said axis of rotation with said vanes interposed between, and rotate with said flanges.

7. The centrifugal compressor according to claim 3 wherein, the vane group adjacent on the outside to said rotatable vanes is able to turn in said peripheral direction while maintaining the arrangement of the individual vanes.

8. The centrifugal compressor according to claim 4 wherein, the vane group adjacent on the outside to said rotatable vanes is able to turn in said peripheral direction while maintaining the arrangement of the individual vanes.

9. The centrifugal compressor according to claim 5 wherein, the vane group adjacent on the outside to said rotatable vanes is able to turn in said peripheral direction while maintaining the arrangement of the individual vanes.

10. The centrifugal compressor according to claim 6 wherein, the vane group adjacent on the outside to said rotatable vanes is able to turn in said peripheral direction while maintaining the arrangement of the individual vanes.

11. The centrifugal compressor according to any of claims 3 to 10 wherein, the ratio of the chord length to the interval between adjacent vanes in the peripheral direction of said rotatable vanes is less than 1.0.

12. The centrifugal compressor according to any of claims 3 to 10 wherein the ratio of the chord length to the interval between adjacent vanes in the peripheral direction of those vanes belonging to the vane group adjacent on the outside to said rotatable vanes is from 0.5 to 2.0.

13. The centrifugal compressor according to claim 11 wherein the ratio of the chord length to the interval between adjacent vanes in the peripheral direction of those vanes belonging to the vane group adjacent on the outside to said rotatable vanes is from 0.5 to 2.0.

14. The centrifugal compressor according to any of claims 1 to 10 wherein the ratio of the length from the center of said impeller to the front edge of a vane belonging to the vane group at a position nearest said impeller toward the outer radius of said impeller is from 1.05 to 1.30.

15. The centrifugal compressor according to claim 11 wherein the ratio of the length from the center of said impeller to the front edge of a vane belonging to the vane group at a position nearest said impeller toward the outer radius of said impeller is from 1.05 to 1.30.

16. The centrifugal compressor according to claim 12 wherein the ratio of the length from the center of said impeller to the front edge of a vane belonging to the vane group at a position nearest said impeller toward the outer radius of said impeller is from 1.05 to 1.30.

17. The centrifugal compressor according to claim 13 wherein the ratio of the length from the center of said impeller to the front edge of a vane belonging to the vane group at a position nearest said impeller toward the outer radius of said impeller is from 1.05 to 1.30.

18. A centrifugal compressor comprising:

an impeller having a rotation axis; and a diffuser provided around said impeller, said diffuser having a first group of vanes including a plurality of vanes provided at a first angle relative to a radial direction of said impeller and a second group of vanes including a plurality of vanes provided at a second angle relative to the radial direction, said first group of vanes and said second group of vanes being concentric about the rotation axis with said first group of vanes being positioned at a greater distance from the rotation axis than said second group of vanes, said first angle being smaller than said second angle.

* * * * *